US012703952B2

(12) United States Patent
Ayers

(10) Patent No.: US 12,703,952 B2
(45) Date of Patent: Aug. 11, 2026

(54) MULTI-PIECE UNDERGROUND BASE FOR A STATIC STRUCTURE

(71) Applicant: Ryan Ayers, Sandyston, NJ (US)

(72) Inventor: Ryan Ayers, Sandyston, NJ (US)

(73) Assignee: FASTEPC, INC., Jacksonville, FL (US)

( * ) Notice: Subject to any disclaimer, the term of this patent is extended or adjusted under 35 U.S.C. 154(b) by 62 days.

(21) Appl. No.: 18/415,968

(22) Filed: Jan. 18, 2024

(65) Prior Publication Data

US 2025/0237033 A1 Jul. 24, 2025

(51) Int. Cl.

| | |
|---|---|
| ***E02D 5/24*** | (2006.01) |
| ***E02D 5/28*** | (2006.01) |
| ***E02D 5/52*** | (2006.01) |
| ***E02D 27/08*** | (2006.01) |

(52) U.S. Cl.

CPC ..... *E02D 5/24* (2013.01); *E02D 5/285* (2013.01); *E02D 5/52* (2013.01); *E02D 27/08* (2013.01)

(58) Field of Classification Search

CPC .. E02D 5/28; E02D 5/285; E02D 5/52; E02D 5/523; E02D 5/526; E02D 27/08; E02D 27/20; E02D 5/24

USPC ..... 405/249, 250, 251, 277, 279

See application file for complete search history.

(56) References Cited

U.S. PATENT DOCUMENTS

| | | | | | |
|---|---|---|---|---|---|
| 265,141 | A * | 9/1882 | Putnam | E02D 5/523 | 405/251 |
| 2,454,956 | A * | 11/1948 | Young | E02D 5/60 | 204/196.18 |
| 3,986,369 | A * | 10/1976 | Rusche | E02D 7/30 | 405/251 |
| 6,561,736 | B1 * | 5/2003 | Doleshal | E02D 37/00 | 405/251 |
| 10,422,097 | B2 * | 9/2019 | Reinert | E02D 7/00 | |
| 2013/0004239 | A1 * | 1/2013 | Roberts | E02B 3/108 | 405/251 |
| 2022/0081860 | A1 * | 3/2022 | Porter | E02D 5/285 | |
| 2022/0205205 | A1 * | 6/2022 | Ayers | E02D 5/285 | |

FOREIGN PATENT DOCUMENTS

| | | | | |
|---|---|---|---|---|
| CN | 112252350 | A * | 1/2021 | E02D 27/12 |
| CN | 112575740 | A * | 3/2021 | A01G 9/023 |
| CN | 217267463 | U * | 8/2022 | E02D 13/00 |
| CN | 117587817 | A * | 2/2024 | E02D 13/04 |
| KR | 100789426 | B1 * | 12/2007 | E02D 5/50 |
| KR | 102160619 | B1 * | 9/2020 | E02D 5/523 |
| KR | 102162460 | B1 * | 10/2020 | E02D 17/04 |

* cited by examiner

*Primary Examiner* — Frederick L Lagman
(74) *Attorney, Agent, or Firm* — The Webb Law Firm

(57) ABSTRACT

A clamshell underground base configured for supporting an above-ground static structure includes a pair of clamshell sections configured to removably connect to each other to define a pipe portion having an open top end, an open bottom end, and an opening extending therebetween. Each of the clamshell sections has a distal end, a proximal end, and a body portion between the distal end and the proximal end. At least one reinforcement plate is connected to the each of the clamshell sections and extends across the opening. Each of the clamshell sections is made from a first material, and the at least one reinforcement plate is made from a second material different from the first material. The first material is a fiber-reinforced polymer composite material, and the second material is steel.

20 Claims, 12 Drawing Sheets

MULTI-PIECE UNDERGROUND BASE FOR A STATIC STRUCTURE

BACKGROUND OF THE DISCLOSURE

Field of the Disclosure

The present application relates generally to supports for static structures and methods for installing the supports, such as underground bases for aboveground static structures and methods for installing such underground bases.

Technical Considerations

Various commercial static structures, such as utility poles in the power transmission industry and lattice towers in the cellular telephone industry, are supported on an underground base. Typically, a conventional underground base is made of concrete. Such concrete bases are associated with a number of disadvantages, including the cost of installation, logistical challenges of getting the concrete mixed, poured, and cured in remote or inaccessible locations where static structures are often installed, and difficulty of installation in inclement weather. Some underground bases are made of steel and are driven into the soil using pressure, such as a hydraulic press.

Load requirements for an underground base are determined based on the size and weight of the static structure that the base must support, various static and dynamic loads that the static structure may experience, such as the weight of power cables attached to the static structure, wind load, or earthquake, and the composition of the underlying soil in which the underground structure is to be installed. A factor of safety is added, which further increases the weight of the underground bases. The increased weight leads to an increase in cost in making, transporting, and installing the underground base. In view of the disadvantages of existing underground bases, it would be desirable to reduce the weight of an underground base for a static structure while meeting the load requirements.

SUMMARY OF THE DISCLOSURE

Accordingly, provided is an improved clamshell underground base and a method for installing the clamshell underground base that overcome the deficiencies of the prior art.

In some non-limiting embodiments or aspects, a clamshell underground base configured for supporting an aboveground static structure may include a pair of clamshell sections configured to removably connect to each other to define a pipe portion having an open top end, an open bottom end, and an opening extending therebetween. Each of the clamshell sections may have a distal end, a proximal end, and a body portion between the distal end and the proximal end. At least one reinforcement plate may be connected to the each of the clamshell sections and may extend across the opening. Each of the clamshell sections may be made from a first material, and the at least one reinforcement plate may be made from a second material different from the first material.

In some non-limiting embodiments or aspects, the first material may be a fiber-reinforced polymer composite material, and the second material may be steel. The fiber-reinforced polymer composite material may include a plurality of fiberglass fabric mats. Each of the plurality of fiberglass fabric mats may be aligned at a 45° angle relative to adjacent fiberglass fabric mats.

In some non-limiting embodiments or aspects, each of the clamshell sections may include a first bend line between the proximal end and the distal end extending along a longitudinal length of the body portion; and a second bend line between the proximal end and the distal end extending along the longitudinal length of the body portion. The body portion of each of the clamshell sections between the first bend line and the second bend line may define a semi-circular shape. The at least one reinforcement plate may be connected to the body portion of each of the clamshell sections between the first bend line and the second bend line. The first bend line may be substantially parallel to the second bend line. The first bend line may define an angle of 90° between a first portion and a second portion of the body portion of each clamshell section, and the second bend line may define an angle of 90° between the first portion and a third portion of the body portion of each clamshell section. The second portion and the third portion of the body portion of each clamshell section may include a plurality of holes for receiving a plurality of mechanical fasteners configured for connecting the clamshell portions to each other.

In some non-limiting embodiments or aspects, the at least one reinforcement plate may be planar.

In some non-limiting embodiments or aspects, at least one side support structure may be removably connected to at least one of the clamshell portions. The at least one side support structure may include a bracket distal end; a bracket proximal end; a bracket body portion between the bracket proximal end and the bracket distal end; and a plurality of bend lines between the bracket proximal end and the bracket distal end extending along a longitudinal length of the bracket body portion. The at least one side support structure further may include a pair of curved connection portions having a curvature corresponding to an outer shape of at least one of the clamshell portions.

In some non-limiting embodiments or aspects, an end cap may be connected to the proximal end of the clamshell portions and may cover at least a portion of the open top end of the pipe portion. The end cap may include a base plate defines a plurality of holes for receiving a plurality of mechanical fasteners configured for connecting the static structure to the base plate. The end cap may include a pair of support plates connected to the base plate, the pair of support plates being separated by a gap configured to receive a part of the body portion of each clamshell portion and the at least one reinforcement plate. At least one stabilizing bracket may connect the base plate to the pair of support plates. In some non-limiting embodiments or aspects, the end cap may include a flat drive plate configured for engagement with a driving machine for driving the clamshell underground base into the ground.

In some non-limiting embodiments or aspects, a clamshell underground base configured for supporting an aboveground static structure may include a pair of clamshell sections configured to removably connect to each other to define a pipe portion having an open top end, an open bottom end, and an opening extending therebetween. Each of the clamshell sections may have a distal end, a proximal end, and a body portion between the distal end and the proximal end. At least one reinforcement plate may be connected to the each of the clamshell sections and may extend across the opening. At least one side support structure may be removably connected to at least one of the clamshell portions, and an end cap may be connected to the proximal end of the clamshell portions and may cover at least a portion of the open top end of the pipe portion. Each of the clamshell sections may be made from a fiber-reinforced polymer composite material, and the at least one reinforcement plate may be made from steel.

Further non-limiting embodiments or aspects are set forth in the following numbered clauses:

Clause 1. A clamshell underground base configured for supporting an above-ground static structure, the clamshell underground base comprising: a pair of clamshell sections configured to removably connect to each other to define a pipe portion having an open top end, an open bottom end, and an opening extending therebetween, each of the clamshell sections having a distal end, a proximal end, and a body portion between the distal end and the proximal end; and at least one reinforcement plate connected to the each of the clamshell sections and extending across the opening, wherein each of the clamshell sections is made from a first material, and wherein the at least one reinforcement plate is made from a second material different from the first material.

Clause 2. The clamshell underground base of claim 1, wherein the first material is a fiber-reinforced polymer composite material, and wherein the second material is steel.

Clause 3. The clamshell underground base of claim 2, wherein the fiber-reinforced polymer composite material comprises a plurality of fiberglass fabric mats.

Clause 4. The clamshell underground base of claim 3, wherein each of the plurality of fiberglass fabric mats is aligned at a 45° angle relative to adjacent fiberglass fabric mats.

Clause 5. The clamshell underground base according to claim 1, wherein each of the clamshell sections comprises: a first bend line between the proximal end and the distal end extending along a longitudinal length of the body portion; and a second bend line between the proximal end and the distal end extending along the longitudinal length of the body portion.

Clause 6. The clamshell underground base according to claim 5, wherein the body portion of each of the clamshell sections between the first bend line and the second bend line defines a semi-circular shape.

Clause 7. The clamshell underground base according to claim 5, wherein the at least one reinforcement plate is connected to the body portion of each of the clamshell sections between the first bend line and the second bend line.

Clause 8. The clamshell underground base according to claim 5, wherein the first bend line is substantially parallel to the second bend line.

Clause 9. The clamshell underground base according to claim 5, wherein the first bend line defines an angle of 90° between a first portion and a second portion of the body portion of each clamshell section, and wherein the second bend line defines an angle of 90° between the first portion and a third portion of the body portion of each clamshell section.

Clause 10. The clamshell underground base according to claim 9, wherein the second portion and the third portion of the body portion of each clamshell section comprise a plurality of holes for receiving a plurality of mechanical fasteners configured for connecting the clamshell portions to each other.

Clause 11. The clamshell underground base according to claim 1, wherein the at least one reinforcement plate is planar.

Clause 12. The clamshell underground base of claim 1, further comprising at least one side support structure removably connected to at least one of the clamshell portions.

Clause 13. The clamshell underground base according to claim 12, wherein the at least one side support structure comprises: a bracket distal end; a bracket proximal end; a bracket body portion between the bracket proximal end and the bracket distal end; and a plurality of bend lines between the bracket proximal end and the bracket distal end extending along a longitudinal length of the bracket body portion.

Clause 14. The clamshell underground base according to claim 13, wherein the at least one side support structure further comprises a pair of curved connection portions having a curvature corresponding to an outer shape of at least one of the clamshell portions.

Clause 15. The clamshell underground base of claim 1, further comprising an end cap connected to the proximal end of the clamshell portions and covering at least a portion of the open top end of the pipe portion.

Clause 16. The clamshell underground base according to claim 15, wherein the end cap comprises a base plate defines a plurality of holes for receiving a plurality of mechanical fasteners configured for connecting the static structure to the base plate.

Clause 17. The clamshell underground base according to claim 16, wherein the end cap comprises a pair of support plates connected to the base plate, the pair of support plates separated by a gap configured to receive a part of the body portion of each clamshell portion and the at least one reinforcement plate.

Clause 18. The clamshell underground base according to claim 17, further comprising at least one stabilizing bracket connecting the base plate to the pair of support plates.

Clause 19. The clamshell underground base according to claim 18, wherein the end cap comprises a flat drive plate configured for engagement with a driving machine for driving the clamshell underground base into the ground.

Clause 20. A clamshell underground base configured for supporting an above-ground static structure, the clamshell underground base comprising: a pair of clamshell sections configured to removably connect to each other to define a pipe portion having an open top end, an open bottom end, and an opening extending therebetween, each of the clamshell sections having a distal end, a proximal end, and a body portion between the distal end and the proximal end; at least one reinforcement plate connected to the each of the clamshell sections and extending across the opening; at least one side support structure removably connected to at least one of the clamshell portions; and an end cap connected to the proximal end of the clamshell portions and covering at least a portion of the open top end of the pipe portion, wherein each of the clamshell sections is made from a fiber-reinforced polymer composite material, and wherein the at least one reinforcement plate is made from steel.

These and other features and characteristics of the present disclosure, as well as the methods of operation and functions of the related elements of structures and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the disclosure.

BRIEF DESCRIPTION OF THE DRAWINGS

Additional advantages and details of the disclosure are explained in greater detail below with reference to the exemplary embodiments or aspects that are illustrated in the accompanying schematic figures, in which.

DETAILED DESCRIPTION OF THE DISCLOSURE

Figure 1:
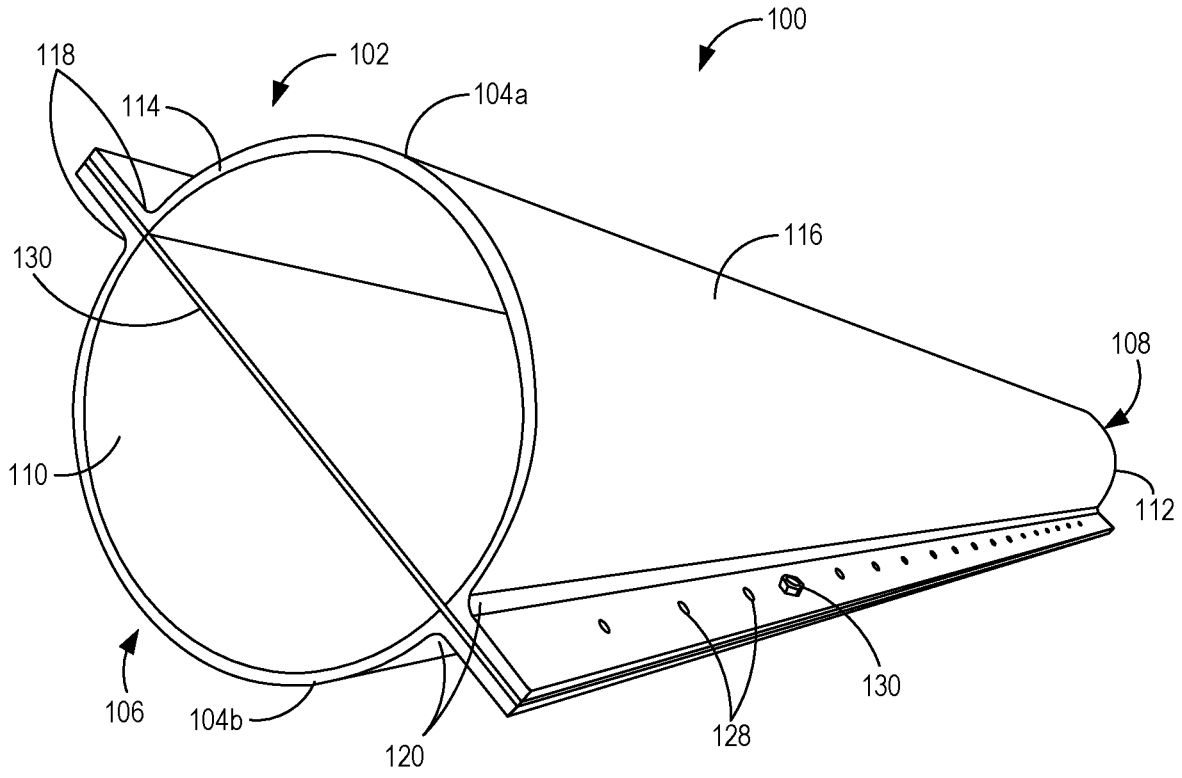
FIG. 1 is a perspective view of a clamshell underground base for a static structure according to one embodiment or aspect of the present disclosure.

The following description is provided to enable those skilled in the art to make and use the described aspects contemplated for carrying out the disclosure. Various modifications, equivalents, variations, and alternatives, however, will remain readily apparent to those skilled in the art. Any and all such modifications, variations, equivalents, and alternatives are intended to fall within the spirit and scope of the present disclosure.

As used herein, the singular form of "a", "an", and "the" includes plural referents unless noted otherwise. With respect to the use of any plural and/or singular terms herein, those having skill in the art can translate from the plural to the singular and/or from the singular to the plural as is appropriate to the context and/or application. The various singular/plural permutations are not expressly set forth herein for sake of clarity.

Spatial or directional terms, such as "left", "right", "inner", "outer", "above", "below", and the like, relate to the embodiments or aspects as shown in the drawing figures and are not to be considered as limiting as the embodiments or aspects can assume various alternative orientations.

All numbers used in the specification and claims are to be understood as being modified in all instances by the term "about". By "about" is meant plus or minus twenty-five percent of the stated value, such as plus or minus ten percent of the stated value. However, this should not be considered as limiting to any analysis of the values under the doctrine of equivalents.

Unless otherwise indicated, all ranges or ratios disclosed herein are to be understood to encompass the beginning and ending values and any and all subranges or sub ratios subsumed therein. For example, a stated range or ratio of "1 to 10" should be considered to include any and all subranges or sub ratios between (and inclusive of) the minimum value of 1 and the maximum value of 10; that is, all subranges or sub ratios beginning with a minimum value of 1 or more and ending with a maximum value of 10 or less. The ranges and/or ratios disclosed herein represent the average values over the specified range and/or ratio.

The terms "first", "second", and the like are not intended to refer to any particular order or chronology, but refer to different conditions, properties, or elements.

All documents referred to herein are "incorporated by reference" in their entirety.

The term "at least" is synonymous with "greater than or equal to".

The term "not greater than" is synonymous with "less than or equal to".

In some instances, one or more components may be referred to herein as "configured to," "operative," "adapted," etc. Those skilled in the art will recognize that "configured to" can generally encompass active-state components and/or inactive-state components and/or standby-state components, unless context requires otherwise.

Some aspects may be described using the expression "coupled" and "connected" along with their derivatives. It should be understood that these terms are not intended as synonyms for each other. For example, some aspects may be described using the term "connected" to indicate that two or more elements are in direct physical or electrical contact with each other. In another example, some aspects may be described using the term "coupled" to indicate that two or more elements are in direct physical or electrical contact. The term "coupled," however, also may mean that two or more elements are not in direct contact with each other, but yet still co-operate or interact with each other.

The herein described subject matter sometimes illustrates different components contained within, or connected with, different other components. It is to be understood that such depicted architectures are merely exemplary, and that in fact many other architectures may be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermediate components. Likewise, any two components so associated can also be viewed as being "operably connected," or "operably coupled," to each other to achieve the desired functionality, and any two components capable of being so associated can also be viewed as being "operably couplable," to each other to achieve the desired functionality. Specific examples of operably couplable include but are not limited to physically mateable and/or physically interacting components.

Some non-limiting embodiments or aspects may be described herein in connection with thresholds. As used herein, satisfying a threshold may refer to a value being greater than the threshold, more than the threshold, higher than the threshold, greater than or equal to the threshold, less than the threshold, fewer than the threshold, lower than the threshold, less than or equal to the threshold, equal to the threshold, etc.

In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that typically a disjunctive word and/or phrase presenting two or more alternative terms, whether in the description, claims, or drawings, should be understood to contemplate the possibilities of including one of the terms, either of the terms, or both terms unless context dictates otherwise. For example, the phrase "A or B" will be typically understood to include the possibilities of "A" or "B" or "A and B."

The term "includes" is synonymous with "comprises".

As used herein, the terms "parallel" or "substantially parallel" mean a relative angle as between two objects (if extended to theoretical intersection), such as elongated objects and including reference lines, that is from 0° to 5°, or from 0° to 3°, or from 0° to 2°, or from 0° to 1°, or from 0° to 0.5°, or from 0° to 0.25°, or from 0° to 0.1°, inclusive of the recited values.

As used herein, the terms "perpendicular" or "substantially perpendicular" mean a relative angle as between two objects at their real or theoretical intersection is from 85° to 90°, or from 87° to 90°, or from 88° to 90°, or from 89° to 90°, or from 89.5° to 90°, or from 89.75° to 90°, or from 89.9° to 90°, inclusive of the recited values.

The discussion of various examples or aspects may describe certain features as being "particularly" or "preferably" within certain limitations (e.g., "preferably", "more preferably", or "even more preferably", within certain limitations). It is to be understood that the disclosure is not limited to these particular or preferred limitations but encompasses the entire scope of the various examples and aspects described herein.

It is noted that any reference to "an embodiment", "one aspect", or "an aspect" means that a particular feature, structure, or characteristic described in connection with the embodiment or aspect is included in at least one embodiment or aspect. Thus, appearances of the phrases "in one embodiment", "in one aspect", or "in an aspect" in various places throughout the specification are not necessarily all referring to the same aspect or embodiment. Furthermore, the particular features, structures or characteristics may be combined in any suitable manner in one or more embodiments or aspects.

One skilled in the art will recognize that the herein described components (e.g., operations), devices, objects, and the discussion accompanying them are used as examples for the sake of conceptual clarity and that various configuration modifications are contemplated. Consequently, as used herein, the specific exemplars set forth and the accompanying discussion are intended to be representative of their more general classes. In general, use of any specific exemplar is intended to be representative of its class, and the non-inclusion of specific components (e.g., operations), devices, and objects should not be taken limiting.

In some non-limiting embodiments or aspects, disclosed herein is a clamshell underground base configured for supporting an above-ground static structure that includes a pair of clamshell sections configured to removably connect to each other to define a pipe portion having an open top end, an open bottom end, and an opening extending therebetween. Each of the clamshell sections has a distal end, a proximal end, and a body portion between the distal end and the proximal end. At least one reinforcement plate is connected to the each of the clamshell sections and may extend across the opening. Each of the clamshell sections is made from a first material, and the at least one reinforcement plate may be made from a second material different from the first material. The first material is a fiber-reinforced polymer composite material, and the second material is steel.

Figure 2:
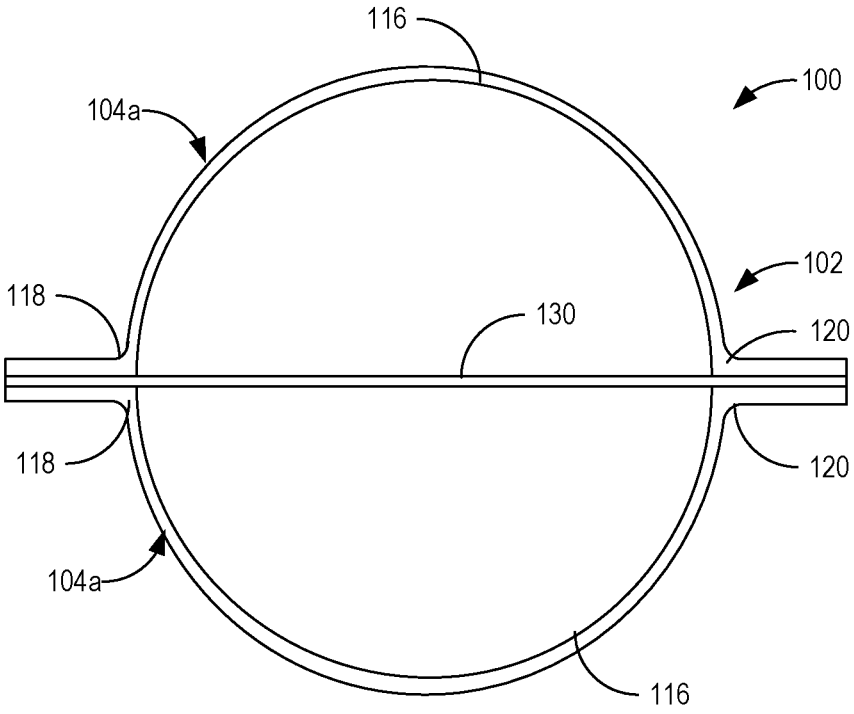
FIG. 2 is a top view of the clamshell underground base shown in FIG. 1.
Figure 3:
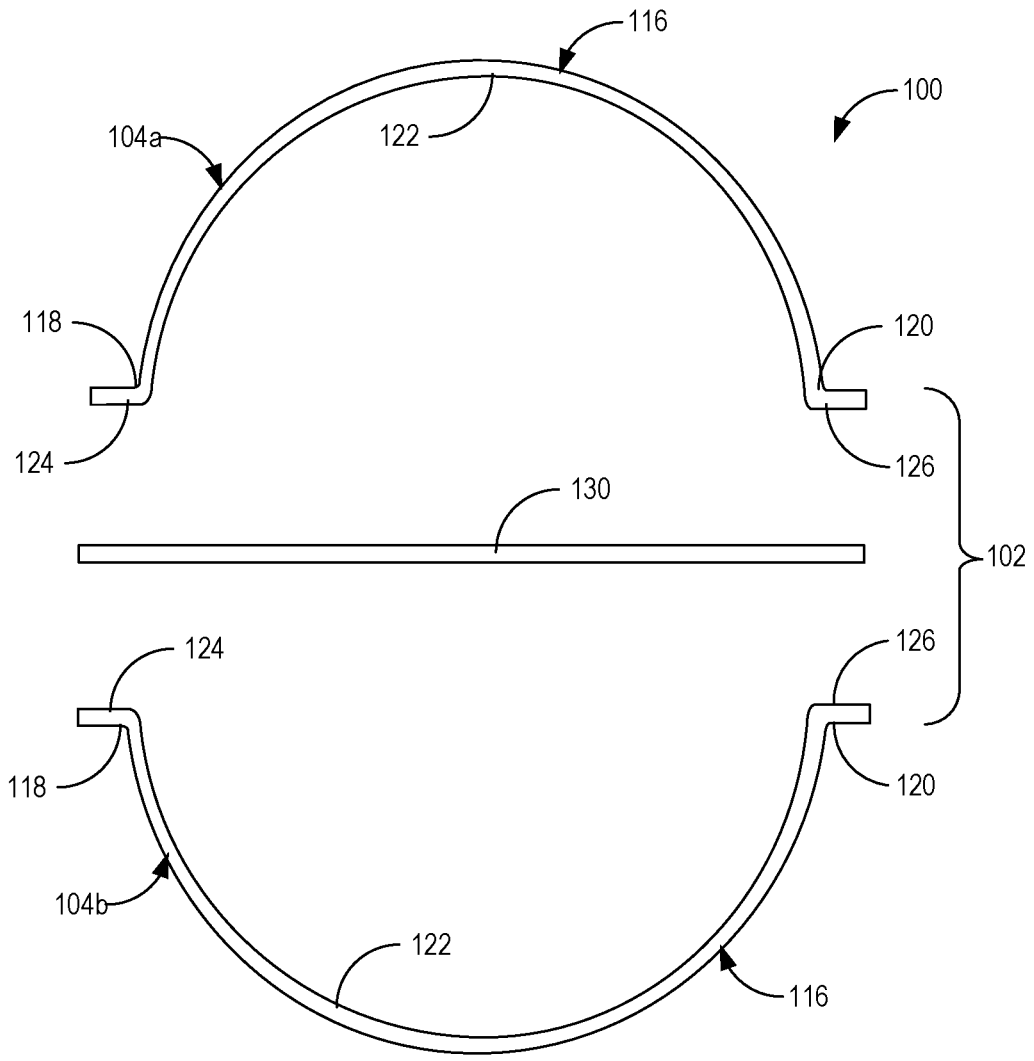
FIG. 3 is an exploded view of the clamshell underground base shown in FIG. 2.

With reference to FIGS. 1-3, an underground base 100 (hereinafter referred to as "base 100") configured for supporting an above-ground static structure is shown in accordance with one embodiment or aspect of the present disclosure. The underground base 100 is configured for underground installation by being pushed or otherwise driven into the soil. For example, the base 100 may be configured for being pushed or otherwise driven into the soil by a hydraulic ram. In some embodiments or aspects, at least a portion of a longitudinal length of the base 100 is configured for being installed underground. In some embodiments or aspects, the base 100 may be configured for supporting an above-ground static structure, such as a utility pole used in the power transmission industry, or a lattice tower in the cellular industry. In this manner, at least a portion of the base 100 may be exposed from the ground to allow for connection of the above-ground static structure to the base 100.

The base 100 may be construed as a multi-piece structure having a plurality of components that are joined together to form the base 100. In this manner, the separate components can be made to have a shorter length or a smaller size for easier transport, and then assembled on site for final installation as a full-length base 100. Alternatively, the multi-piece structure can be assembled at a factory and shipped to the site as an entire assembled base 100.

The base 100 provides a lightweight structure compared to conventional reinforced concrete bases while meeting the same load and soil support requirements as the concrete bases. The reduced weight of the base 100 compared to conventional concrete bases allows the base to be easily and efficiently transported to the installation site. Additionally, the base 100 can be installed into the soil in a matter of hours and does not require lengthy curing times associated with pouring conventional concrete bases. Unlike the concrete bases, the installation of the base 100 is not dependent on the weather conditions. In some embodiments or aspects, at least a portion of the base 100 may be made from a composite material, such as a fiber-reinforced polymer composite material. Fiber-reinforced polymer composite offers not only high strength to weight ratio, but also reveals exceptional properties such as high durability; stiffness; damping property; flexural strength; and resistance to corrosion, wear, impact, and fire.

With reference to FIGS. 1-3, the base 100 has a body 102 made from a pair of clamshell sections 104*a*, 104*b* that are connected together to define a three-dimensional structure that delimits an outer shape of the base 100. In some embodiments or aspects, each of the clamshell sections 104*a*, 104*b* may have a semi-circular shape such that, when combined, the two clamshell sections 104*a*, 104*b* define a base 100 having a circular cross section. In some embodiments or aspects, the base 100 may have a diameter of 24"-72", although other dimensions are not precluded. In other embodiments or aspects, the two clamshell sections 104*a*, 104*b* may have any other shape such that, when combined, the clamshell sections 104*a*, 104*b* define any desired prismatic three-dimensional structure. For example, the base 100 can have an oval, triangular, rectangular, square, or any other cross-sectional shape when the two clamshell sections 104*a*, 104*b* are assembled together.

As shown in FIG. 1, when connected, the clamshell sections 104*a*, 104*b* define the base 100 having an open top end 106, an open bottom end 108, and an opening 110 extending therebetween. Each of the clamshell sections 104*a*, 104*b* has a distal end 112, a proximal end 114, and a body portion 116 between the distal end 112 and the proximal end 114. The distal end 112 is configured to be furthest from the soil surface when the base 100 is installed in the soil and the proximal end 114 is configured to be closest to the soil surface (i.e. slightly above, at the same level, or slightly below). In some embodiments, the distal end 112 may be beveled for easier transition into the soil. The clamshell portions 104*a*, 104*b* may be identical to each other. In some embodiments or aspects, at least one of the clamshell portions 104*a*, 104*b* may be different from the other clamshell portion 104*a*, 104*b*.

The body portion 116 may have a thickness up to 3" and a length of up to 100', although other dimensions are not precluded. The size and shape of the base 100 is desirably selected to meet the load requirements for the above-ground static structure that will be supported by the base 100. The wider that a diameter of the base 100 is, the better suited the base 100 is for withstanding an overturning moment force to prevent the static structure from tipping over.

With continued reference to FIGS. 1-3, each of the clamshell sections 104*a*, 104*b* has a first bend line 118 between the proximal end 114 and the distal end 112 extending along a longitudinal length of the body portion 116, and a second bend line 120 between the proximal end 114 and the distal end 112 extending along a longitudinal length of the body portion 116. The body portion 116 of each of the clamshell sections 104*a*, 104*b* between the first bend line 118 and the second bend line 118 defines a semi-circular shape. The first bend line 118 is substantially parallel with the second bend line 120.

As shown in FIG. 3, in some embodiments or aspects, the first bend line 118 defines an angle of 90° between a first portion 122 and a second portion 124 of the body portion 116 of each clamshell section 104*a*, 104*b*, and the second bend line 120 defines an angle of 90° between the first portion 122 and a third portion 126 of the body portion 116 of each clamshell section 104*a*, 104*b*. The second portion 124 and the third portion 126 of the body portion 116 of each clamshell section 116 comprise a plurality of holes 128 (shown in FIG. 1) for receiving a plurality of mechanical fasteners 130 configured for connecting the clamshell portions 104*a*, 104*b* to each other. The clamshell portions 104*a*, 104*b* may be connected to each other along at least a portion of a longitudinal length of the body portion 116. For example, the clamshell portions 104*a*, 104*b* may be connected to each other along an entire longitudinal length of the body portion 116. In some embodiments or aspects, the clamshell portions 104*a*, 104*b* are connected to teach other via welding, adhesive, fasteners, and any combination thereof.

With continued reference to FIGS. 1-3, the base 100 has least one reinforcement plate 130 connected thereto. In some embodiments or aspects, the reinforcement plate 130 may be positioned between the clamshell portions 104*a*, 104*b*, such that the reinforcement plate 130 is clamped by the clamshell portions 104*a*, 104*b* when the clamshell portions 104*a*, 104*b* are connected to each other. The reinforcement plate 130 may extend across an interior of the three-dimensional structure defined by the clamshell portions 104*a*, 104*b* and may extend along at least a portion of the longitudinal length of the clamshell portions 104*a*, 104*b*. In some embodiments or aspects, the reinforcement plate 130 may have openings that can be aligned with the holes 128 on the clamshell portions 104*a*, 104*b* (shown in FIG. 1) such that the fasteners 130 extend through the openings in the reinforcement plate 130. In other embodiments or aspects, the reinforcement plate 130 may be adhesively connected to the clamshell portions 104*a*, 104*b*.

The reinforcement plate 130 may extend along at least a portion of the longitudinal length of the clamshell portions 104*a*, 104*b*. The reinforcement plate 130 may have a thickness of 0.25" to 3.0" and may be formed to have a planar shape. The reinforcement plate 130 is desirably made from a material different from the material of the clamshell portions 104*a*, 104*b*. In some embodiments or aspects, the reinforcement plate 130 may be made from steel, such as carbon steel. The reinforcement plate 130 increases the strength of the base 100, such as by resisting torsional forces, without adding a substantial weight to the overall assembly. For example, the reinforcement plate 130 prevents buckling of the clamshell portions 104*a*, 104*b* and reinforces the base 100. In some embodiments or aspects, the reinforcement plate 130 may have a tubular form and may be disposed within the opening of the base 100.

Figure 12:
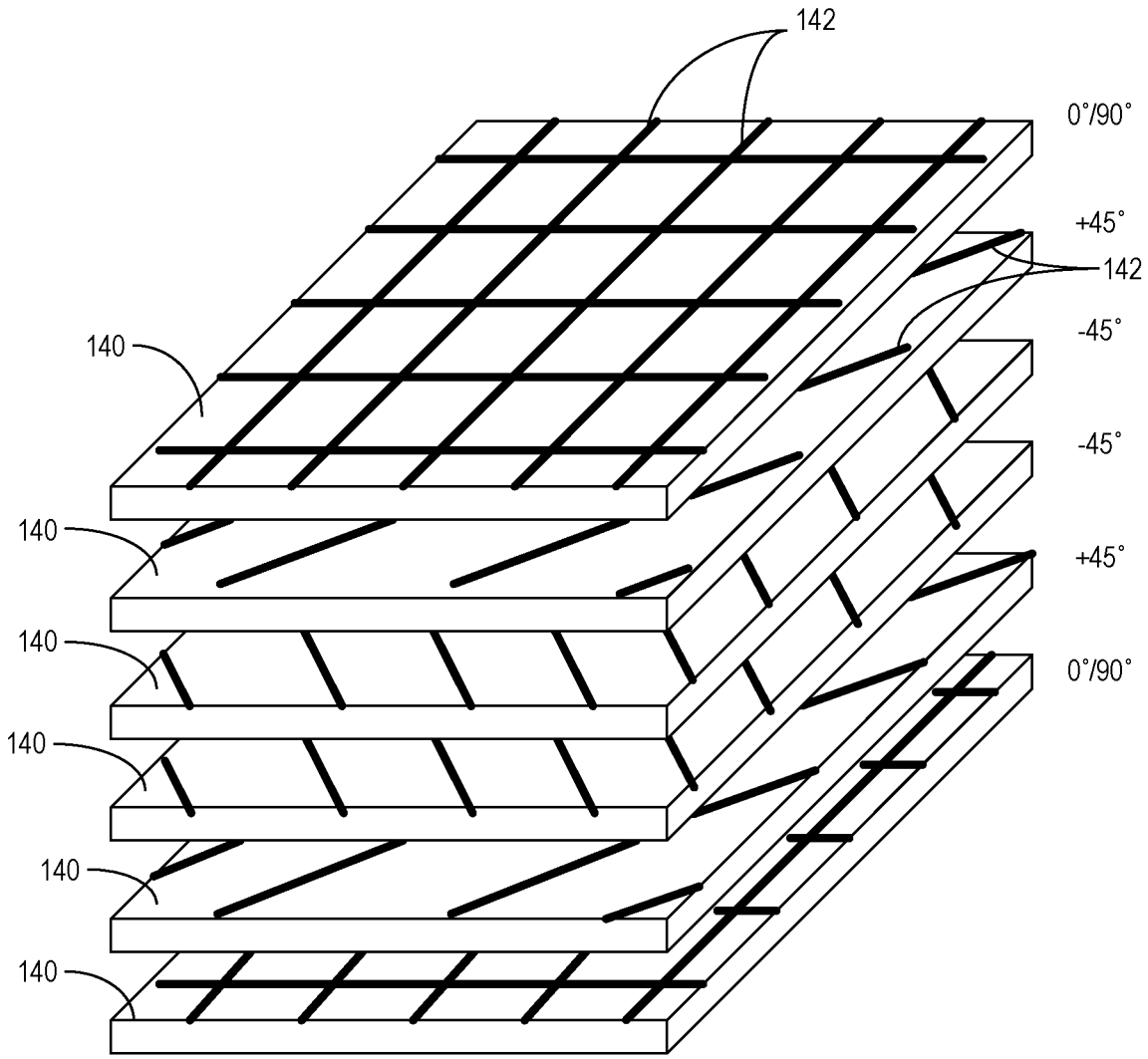
FIG. 12 an exploded perspective view of a composite sidewall for the clamshell underground base according to one embodiment or aspect of the present disclosure.

In some embodiments or aspects, the clamshell portions 104*a*, 104*b* may be made from a composite material, such as a fiber-reinforced polymer composite material. For example, the clamshell portions 104*a*, 104*b* may be made from e-glass, where a plurality of fiberglass fabric mats 45° angle relative to adjacent fiberglass fabric mats 140 are laid on top of each with a 45° angle relative to adjacent fiberglass fabric mats such that directions of the fibers 142 of adjacent mats 140 intersect at oblique angles (see FIG. 12). A polymer resin, such as an isophthalic polymer resin, is then vacuum infused into the mats 140 to drive the resin into the mats 140. The composite material has corrosion resistant properties such that the base 100 does not have to be subjected to separate corrosion resistant treatment, thereby saving time and cost.

Figure 4:
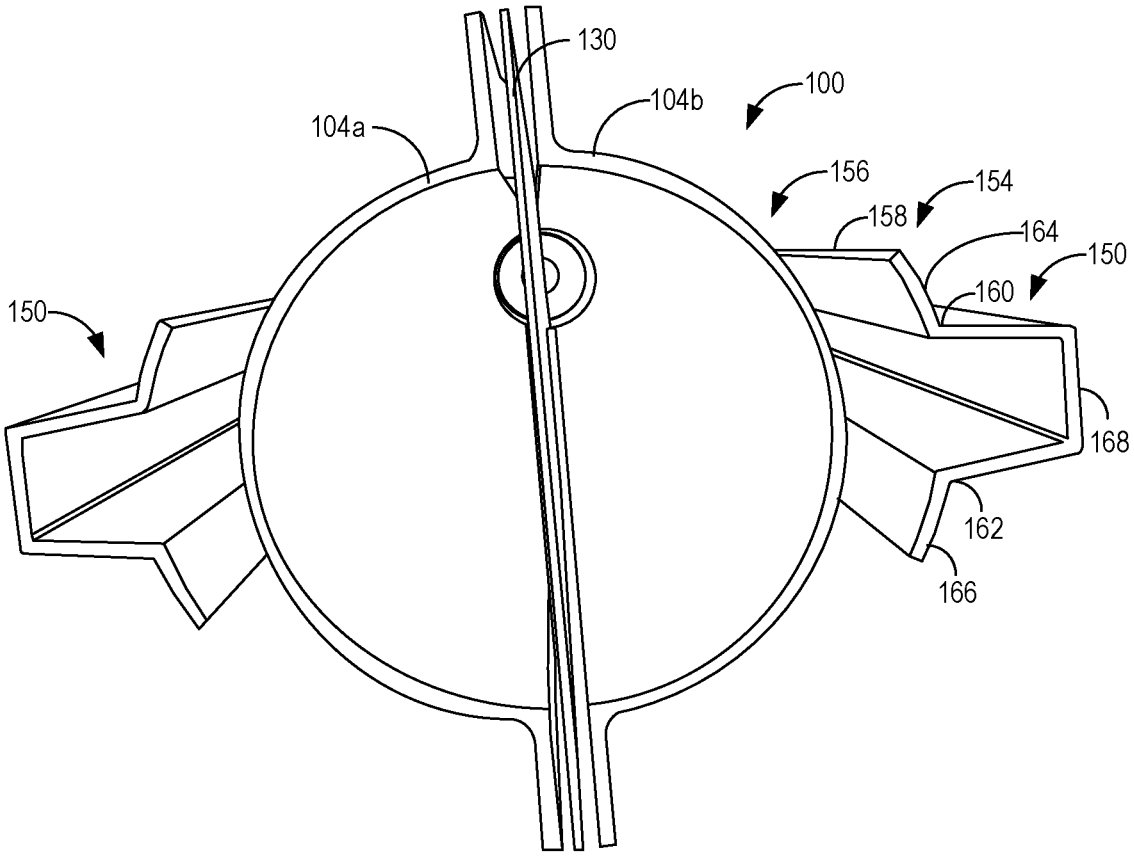
FIG. 4 is a top perspective view of the clamshell underground base of FIG. 1 shown with a pair of side support structures in accordance with one embodiment or aspect of the present disclosure.
Figure 5:
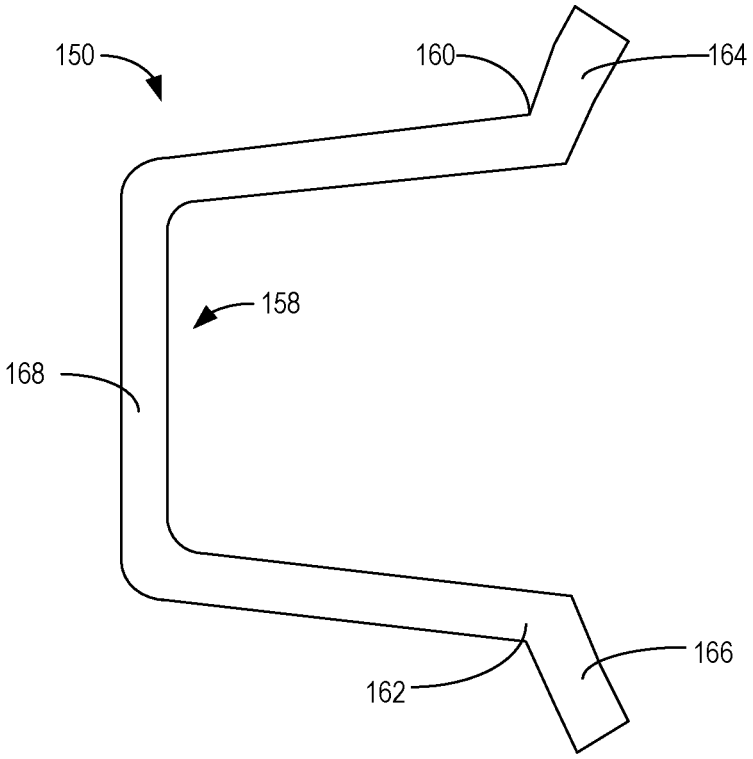
FIG. 5 is a top view of one of the side support structures shown in FIG. 4.

With reference to FIGS. 4-5, the base 100 further includes at least one side support structure 150 connected to an outside surface of the clamshell portions 104*a*, 104*b*. Each side support structure 150 may extend along at least a portion of a longitudinal length of the base 100. In some embodiments or aspects, each side support structure 150 may be connectable to the outside surface of one of the clamshell portions 104*a*, 104*b* via one or more fasteners (not shown).

With reference to FIG. 4, each side support structure 150 has a bracket distal end 154, a bracket proximal end 156, a bracket body portion 158 between the bracket proximal end 156 and the bracket distal end 154. The side support structure 150 further has a first bend line 160 between the bracket proximal end 156 and the bracket distal end 154 extending along a longitudinal length of the bracket body portion 158, and a second bend line 162 between the bracket proximal end 156 and the bracket distal end 154 extending along a longitudinal length of the bracket body portion 158. The first bend line 160 and the second bend line 162 may be substantially parallel to each other.

The first bend line 160 and the second bend line 162 may extend along the entire length of the bracket body portion 158. In this manner, the first bend line 160 and the second bend line 162 divide the bracket body portion 158 into a first flap portion 164, a second flap portion 166, and a central portion 168. The first and second flap portions 164, 166 may be curved to correspond to a curvature of the outer surface of the clamshell portions 104*a*, 104*b*. In some embodiments or aspects, the side support structure 150 may be made from the same material as the clamshell portions 104*a*, 104. In other embodiments or aspects, the side support structure 150 may be made from a different material as the clamshell portions 104*a*, 104*b*. For example, the side support structure 150 may be made from steel.

Figure 6:
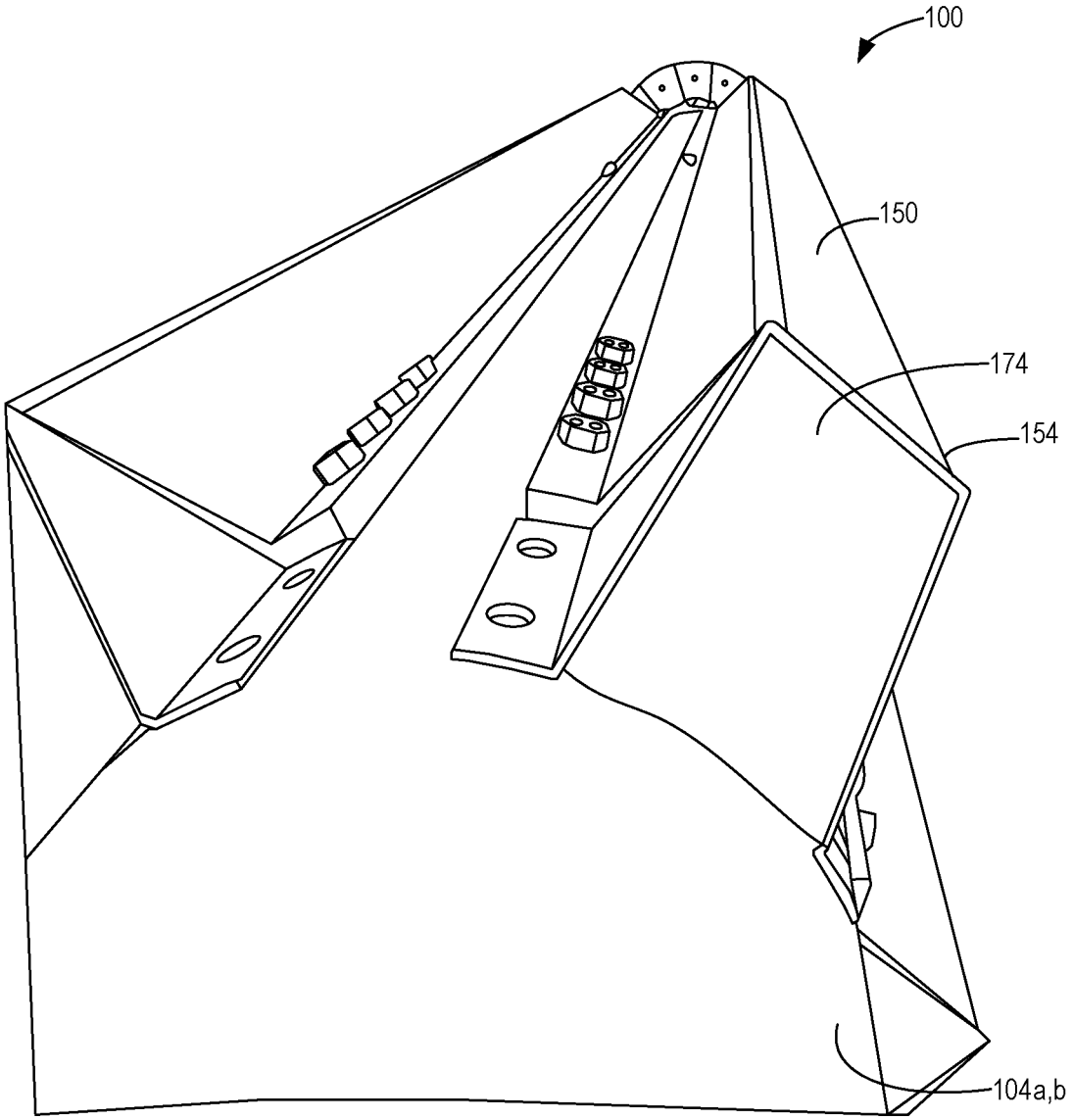
FIG. 6 is a detailed perspective view of an end cap for the side support structures shown in FIG. 4.

With reference to FIG. 6, each side support structure 150 has a cap 174 at the bracket distal end 154 for enclosing the side support structure 150. In some embodiments or aspects, the cap 174 provides compression or uplift strength to the base 100. The cap 174 may be made from steel.

Figure 7:
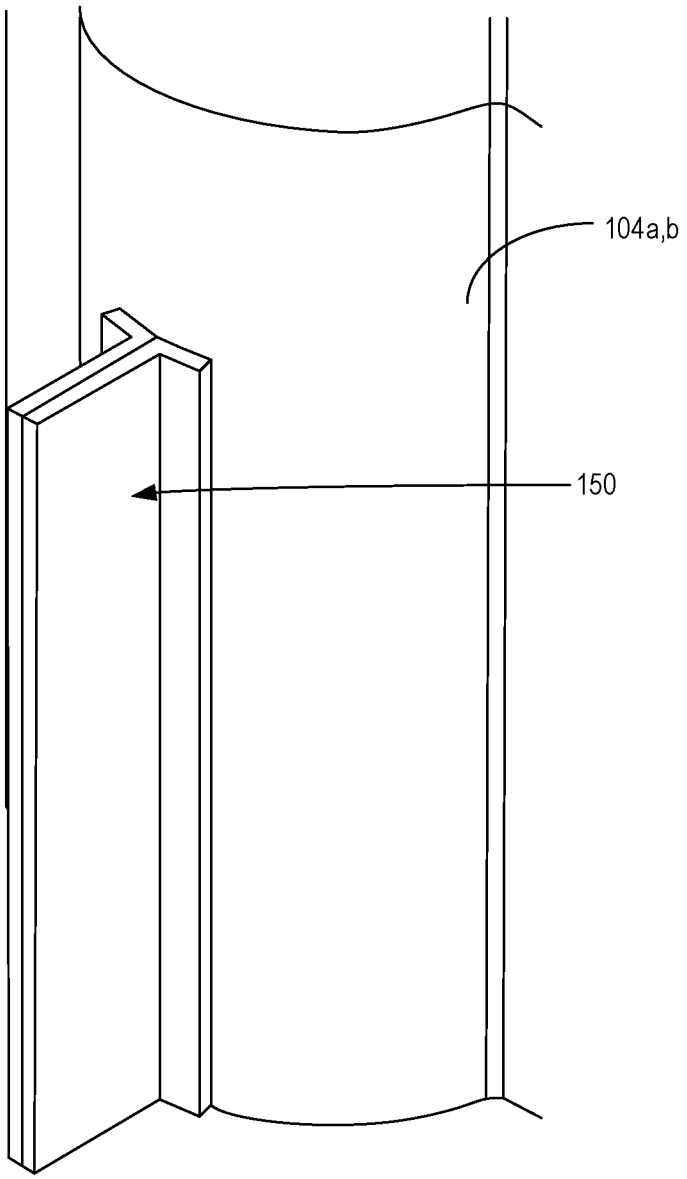
FIG. 7 is a partial side perspective view of the clamshell underground base of FIG. 1 shown with a side support structure in accordance with another embodiment or aspect of the present disclosure.

With reference to FIG. 7, the side support structure 150 may have a T-shape, with curved edges configured to correspond to a curvature of the outside surface of the clamshell portions 104*a*, 104*b*. In some embodiments or aspects, the side support structure 150 shown in FIG. 7 may be made from the same material as the clamshell portions 104*a*, 104. In other embodiments or aspects, the side support structure 150 shown in FIG. 7 may be made from a different material as the clamshell portions 104*a*, 104*b*. For example, the side support structure 150 may be made from steel.

Figure 8:
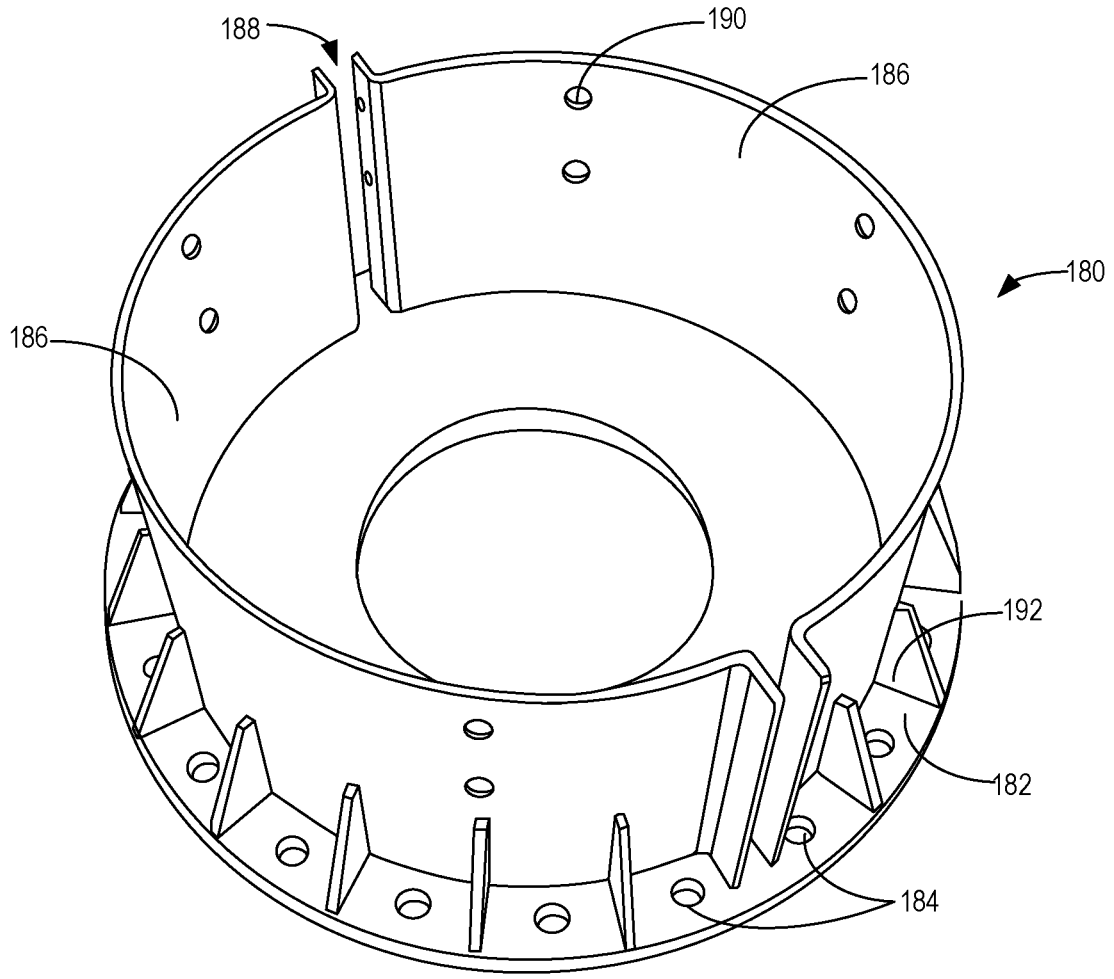
FIG. 8 is a bottom perspective view of a pile cap for use with the clamshell underground base.
Figure 9:
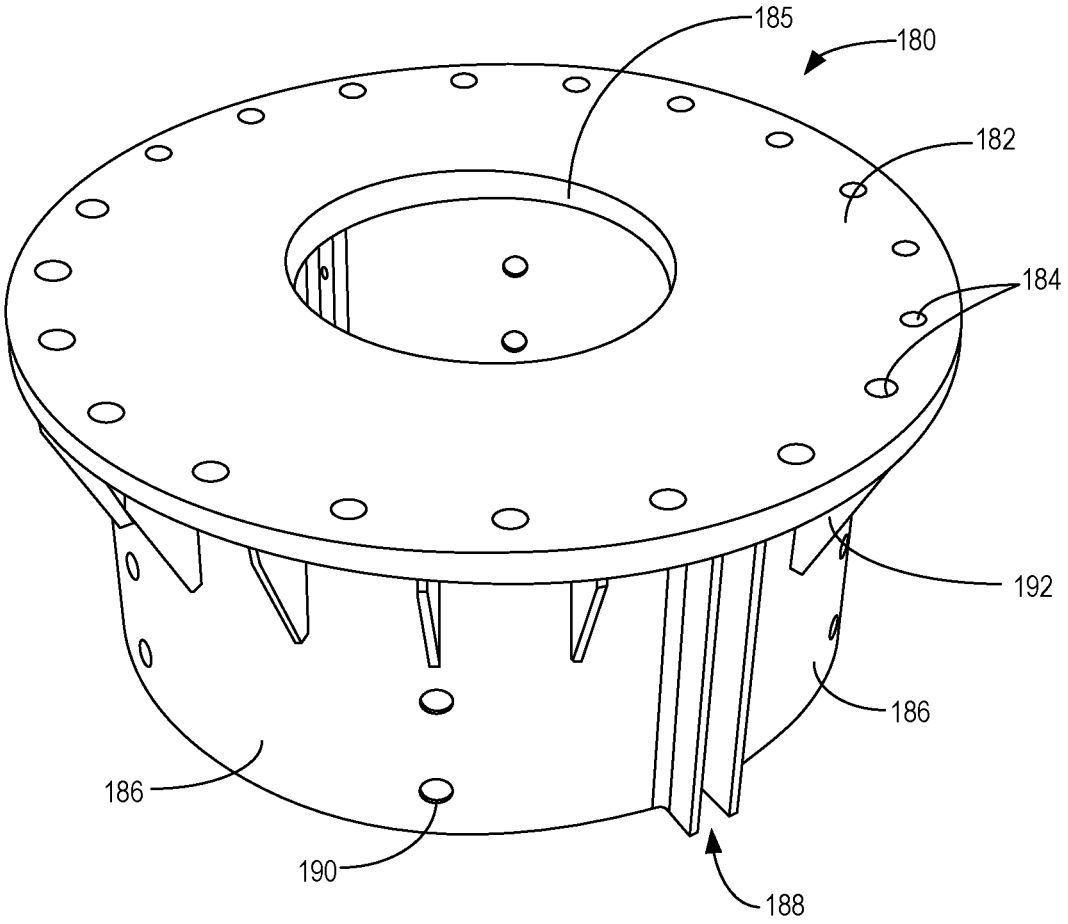
FIG. 9 is top perspective view of the pile cap shown in FIG. 8.
Figure 10:
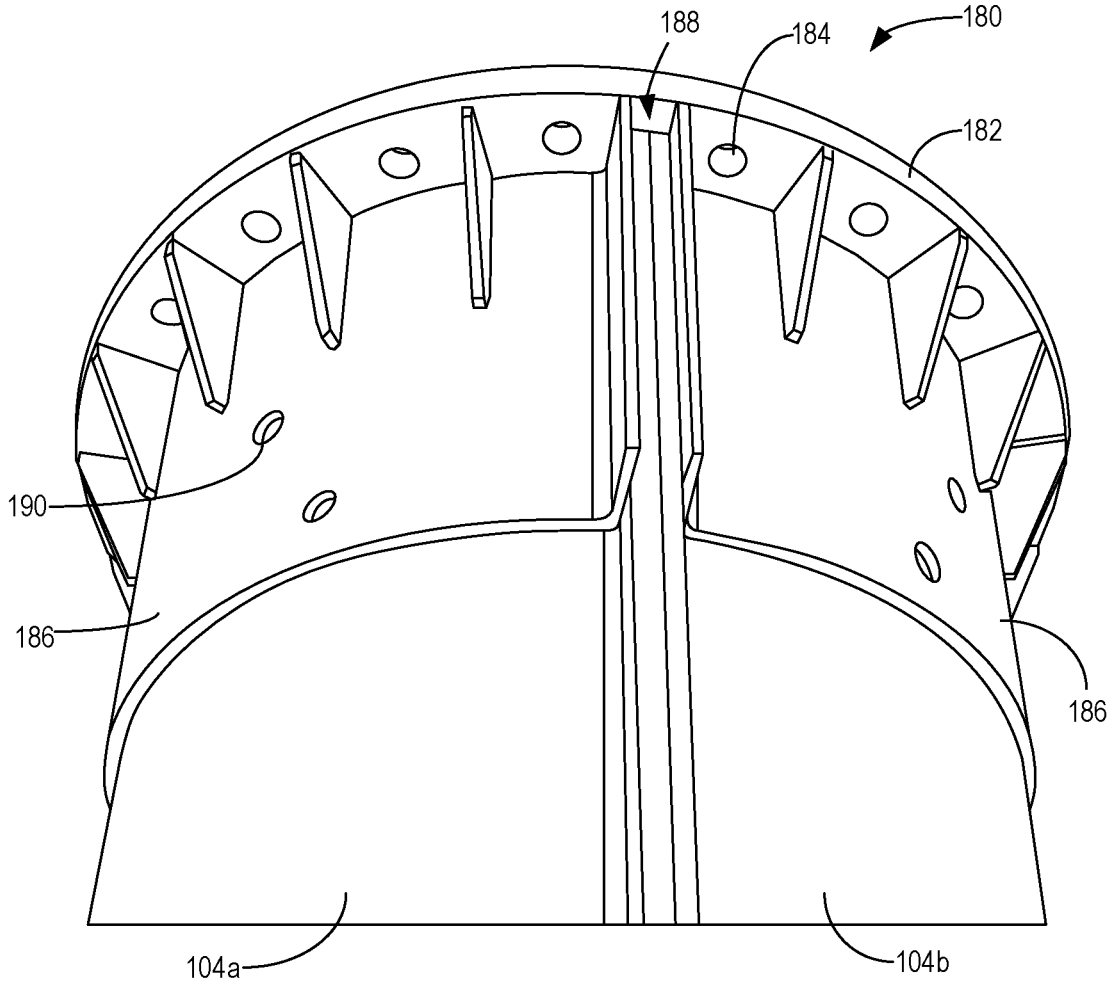
FIG. 10 is a perspective view of the pile cap shown in FIG. 8 installed on the clamshell underground base.
Figure 11:
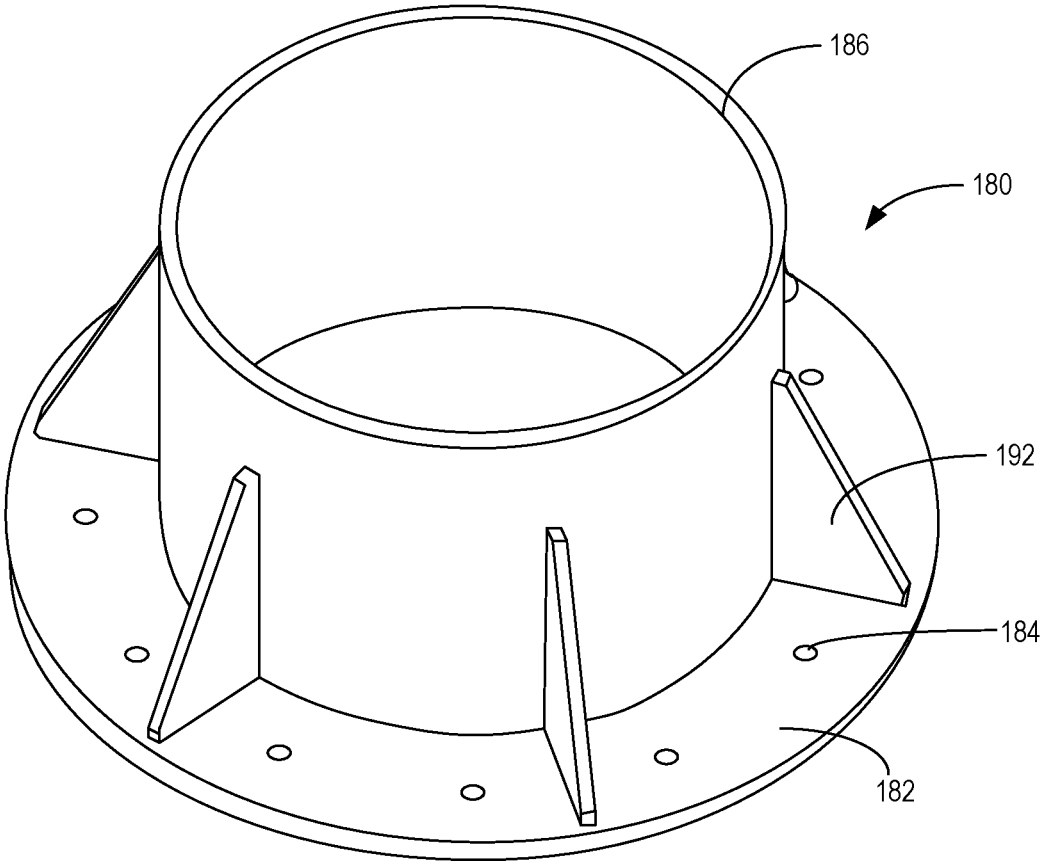
FIG. 11 is a bottom perspective view of a drive cap for use with the clamshell underground base.

With reference to FIG. 8-10, an end cap 180 is provided for connecting to the proximal end 114 of the base 100. The end cap 180 is configured to connect to the terminal end of the clamshell portions 104*a*, 104*b* and encloses the open top end of the base 100 (see FIG. 10). The end cap 180 has a base plate 182 that defines a plurality of first holes 184 for receiving a plurality of mechanical fasteners configured for connecting the static structure to the base plate 182. The base plate 182 further has at least one second hole 185 extending through a central portion of the base plate 180. The base plate 180 may be made from steel. In some embodiments, the base plate 182 may be formed without the second hole 184 (see FIG. 11), wherein the base plate 182 can be used as a support surface for driving the base 100 into the ground.

With continued reference to FIGS. 8-10, the end cap 180 has a pair of support plates 186 connected to the base plate 182 and protruding from the base plate 182 in the direction of the base 100. The support plates 186 are dimensioned to surround at least a portion of the base 100 and provide stability to the base 100 by resisting lateral loads imposed on the base 100 due to side loading on the above-ground static structure. The pair of support plates 186 are separated by a gap 188 configured to receive a part of the body portion of each clamshell portion 104*a*, 104*b* and the at least one reinforcement plate 130 when the end cap 180 is installed on the base 100 (see FIG. 10). In some embodiments, a plurality of openings 190 may be provided on at least one of the support plates 186 for receiving fasteners to connect the end cap 180 to the base 100.

Referring to FIGS. 8-10, the base 100 further includes at least one stabilizing bracket 192 connected at a joint between the base plate 182 and the support plates 186. In some non-limiting embodiments or aspects, the at least one stabilizing bracket 192 may have a first portion connected to the base plate 182 and a second portion connected to one of the support plates 186.

Although the present disclosure has been described in detail for the purpose of illustration based on what are currently considered to be the most practical and preferred embodiments or aspects, it is to be understood that such detail is solely for that purpose and that the disclosure is not limited to the disclosed embodiments or aspects, but, on the contrary, is intended to cover modifications and equivalent arrangements that are within the spirit and scope of the appended claims. For example, it is to be understood that the present disclosure contemplates that, to the extent possible, one or more features of any embodiment or aspect can be combined with one or more features of any other embodiment or aspect.

What is claimed is:

1. A clamshell underground base configured for supporting an above-ground static structure, the clamshell underground base comprising:

a pair of clamshell sections configured to removably connect to each other to define a pipe portion having an open top end, an open bottom end, and an opening extending therebetween, each of the clamshell sections having a distal end, a proximal end, and a body portion between the distal end and the proximal end; and at least one reinforcement plate connected to the each of the clamshell sections and extending across the opening, wherein each of the clamshell sections is made from a first material, wherein the at least one reinforcement plate is made from a second material different from the first material, and wherein the reinforcement plate is clamped between the clamshell portions and extends along the opening in a direction from the open top end to the open bottom end.

2. The clamshell underground base of claim 1, wherein the first material is a fiber-reinforced polymer composite material, and wherein the second material is steel.

3. The clamshell underground base of claim 2, wherein the fiber-reinforced polymer composite material comprises a plurality of fiberglass fabric mats.

4. The clamshell underground base of claim 3, wherein each of the plurality of fiberglass fabric mats is aligned at a 45° angle relative to adjacent fiberglass fabric mats.

5. The clamshell underground base according to claim 1, wherein each of the clamshell sections comprises:

a first bend line between the proximal end and the distal end extending along a longitudinal length of the body portion; and a second bend line between the proximal end and the distal end extending along the longitudinal length of the body portion.

6. The clamshell underground base according to claim 5, wherein the body portion of each of the clamshell sections between the first bend line and the second bend line defines a semi-circular shape.

7. The clamshell underground base according to claim 5, wherein the at least one reinforcement plate is connected to the body portion of each of the clamshell sections between the first bend line and the second bend line.

8. The clamshell underground base according to claim 5, wherein the first bend line is substantially parallel to the second bend line.

9. The clamshell underground base according to claim 5, wherein the first bend line defines an angle of 90° between a first portion and a second portion of the body portion of each clamshell section, and wherein the second bend line defines an angle of 90° between the first portion and a third portion of the body portion of each clamshell section.

10. The clamshell underground base according to claim 9, wherein the second portion and the third portion of the body portion of each clamshell section comprise a plurality of holes for receiving a plurality of mechanical fasteners configured for connecting the clamshell portions to each other.

11. The clamshell underground base according to claim 1, wherein the at least one reinforcement plate is planar.

12. The clamshell underground base of claim 1, further comprising at least one side support structure removably connected to at least one of the clamshell portions.

13. The clamshell underground base according to claim 12, wherein the at least one side support structure comprises:

a bracket distal end;

a bracket proximal end;

a bracket body portion between the bracket proximal end and the bracket distal end; and a plurality of bend lines between the bracket proximal end and the bracket distal end extending along a longitudinal length of the bracket body portion.

14. The clamshell underground base according to claim 13, wherein the at least one side support structure further comprises a pair of curved connection portions having a curvature corresponding to an outer shape of at least one of the clamshell portions.

15. The clamshell underground base of claim 1, further comprising an end cap connected to the proximal end of the clamshell portions and covering at least a portion of the open top end of the pipe portion.

16. The clamshell underground base according to claim 15, wherein the end cap comprises a base plate that defines a plurality of holes for receiving a plurality of mechanical fasteners configured for connecting the static structure to the base plate.

17. The clamshell underground base according to claim 16, wherein the end cap comprises a pair of support plates connected to the base plate, the pair of support plates separated by a gap configured to receive a part of the body portion of each clamshell portion and the at least one reinforcement plate.

18. The clamshell underground base according to claim 17, further comprising at least one stabilizing bracket connecting the base plate to the pair of support plates.

19. The clamshell underground base according to claim 18, wherein the end cap comprises a flat drive plate configured for engagement with a driving machine for driving the clamshell underground base into the ground.

20. A clamshell underground base configured for supporting an above-ground static structure, the clamshell underground base comprising:

a pair of clamshell sections configured to removably connect to each other to define a pipe portion having an open top end, an open bottom end, and an opening extending therebetween, each of the clamshell sections having a distal end, a proximal end, and a body portion between the distal end and the proximal end;

at least one reinforcement plate connected to the each of the clamshell sections and extending across the opening;

at least one side support structure removably connected to at least one of the clamshell portions; and an end cap connected to the proximal end of the clamshell portions and covering at least a portion of the open top end of the pipe portion, wherein each of the clamshell sections is made from a fiber-reinforced polymer composite material, wherein the at least one reinforcement plate is made from steel, and wherein the reinforcement plate is clamped between the clamshell portions and extends along the opening in a direction from the open top end to the open bottom end.

* * * * *